US009214305B2

(12) United States Patent
Lang et al.

(10) Patent No.: US 9,214,305 B2
(45) Date of Patent: Dec. 15, 2015

(54) SWITCH WITH QUENCHING CHAMBER

(75) Inventors: Volker Lang, Bonn (DE); Lutz Friedrichsen, Cologne (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 315 days.

(21) Appl. No.: 13/992,347

(22) PCT Filed: Dec. 7, 2011

(86) PCT No.: PCT/EP2011/072094

§ 371 (c)(1),
(2), (4) Date: Jun. 24, 2013

(87) PCT Pub. No.: WO2012/076604

PCT Pub. Date: Jun. 14, 2012

(65) Prior Publication Data

US 2013/0264311 A1 Oct. 10, 2013

(30) Foreign Application Priority Data

Dec. 7, 2010 (EP) ..... 10194011

(51) Int. Cl.

| | |
|---|---|
| ***H01H 33/18*** | (2006.01) |
| ***H01H 1/20*** | (2006.01) |
| ***H01H 9/34*** | (2006.01) |
| ***H01H 9/44*** | (2006.01) |
| *H01H 33/59* | (2006.01) |

(52) U.S. Cl.

CPC ..... *H01H 33/182* (2013.01); *H01H 1/2025* (2013.01); *H01H 9/346* (2013.01); *H01H 9/443* (2013.01); *H01H 33/596* (2013.01)

(58) Field of Classification Search

CPC ..... H01H 9/44; H01H 9/346; H01H 9/34; H01H 9/30; H01H 9/443

USPC ..... 218/15, 22–26, 34–42, 103, 104, 154, 218/156; 335/201, 202

See application file for complete search history.

(56) References Cited

U.S. PATENT DOCUMENTS

| | | | | |
|---|---|---|---|---|
| 2,332,446 | A | 10/1943 | Konrad | |
| 5,416,455 | A | 5/1995 | Moldovan et al. | |
| 7,915,985 | B2 * | 3/2011 | Schmitz et al. | 335/201 |
| 8,502,102 | B2 * | 8/2013 | Eriksson et al. | 218/34 |
| 2013/0264310 | A1 * | 10/2013 | Lang et al. | 218/2 |

FOREIGN PATENT DOCUMENTS

| | | |
|---|---|---|
| EP | 0473014 A2 | 3/1992 |

* cited by examiner

*Primary Examiner* — Amy Cohen Johnson
*Assistant Examiner* — Marina Fishman
(74) *Attorney, Agent, or Firm* — Leydig, Voit & Mayer, Ltd.

(57) ABSTRACT

A switch for multi-pole direct current service independent of polarity includes a plurality of switching chambers. Each chamber includes a double interrupter having two separate fixed contacts with a first contact area, a movable contact piece with two second contact areas, each for creating a connection between the contact areas in an ON state and for separating the contact areas in an OFF state, and at least two quenching devices for quenching arcs occurring when the OFF state is brought about. The switch also includes magnets for exerting a magnetic field in an area of the contact areas to exert a magnetic force on the arcs and drive the arcs, independent of their current direction, in the direction of one of the erasing devices. The contact pieces are disposed with the second contact areas essentially in a line perpendicular to a direction of motion of the arcs.

15 Claims, 4 Drawing Sheets

SWITCH WITH QUENCHING CHAMBER

CROSS REFERENCE TO RELATED APPLICATIONS

This application is a U.S. National Phase application under 35 U.S.C. §371 of International Application No. PCT/EP2011/072094, filed on Dec. 7, 2011, and claims benefit to European Patent Application No. EP 10194011.2, filed on Dec. 7, 2010. The International Application was published in German on Jun. 14, 2012, as WO 2012/076604 A1 under PCT Article 21 (2).

FIELD

The invention provides a switch with quenching mechanisms for quickly quenching an arc in the disconnection process.

BACKGROUND

Electrical switches are components in a circuit which create (switch state "ON" or ON state) or break (switch state "OFF" or OFF state) an electrically conductive connection by means of internal, electrically conductive contacts. In the case of a current-carrying connection that is to be broken, current flows through the contacts until these are separated. If an inductive current circuit through a switch is broken, the flowing current cannot directly go to zero. In this case, an arc forms between the contacts. The arc is a gas discharge in a non-conductive medium, for example air. In switches in alternating current service (AC), the arc is quenched regularly at the zero-crossing point of the alternating current. Due to the lack of a zero crossing of the current, stable burning arcs occur in switches in direct current (DC) service, so long as the arc voltage is distinctly smaller than the operating voltage, when contacts are separated (switching off). When the circuit is operated with sufficient current and voltage (typically at over 1 A and over 50V), the arc will not extinguish on its own. For this purpose, quenching chambers are employed in such switches for quenching the arc. The arcing time (the duration of the arc burning) should be kept as short as possible, because the arc generates a significant amount of heat, and it burns off the contacts and/or generates thermal load on the switching chamber in the switch and this reduces the service life of the switch. In case of two pole or multi-pole switches with two or more switching chambers, the arcs generate a corresponding higher amount of heat than in case of one pole switches. It is especially important in this case that the arc is quenched quickly.

As a rule, quenching of the arc is accelerated by the use of a magnetic field that is polarized so that a driving force is exerted on the arc in the direction of the quenching chamber. Here, the magnitude of the driving force depends on the strength of the magnet or magnets. Permanent magnets are generally used to create a strong magnetic field. Unfortunately, the driving force of the magnetic field in the direction of the quenching chamber only occurs when the current flows in a particular direction. In order to prevent switch installation errors due to polarity or if switches are needed for both current directions, switches having a quick quenching process for arcs occurring between the open contacts during opening of the switch, that is independent of the respective polarity, would be desirable. This quenching function would be especially desirable in two pole switches with a structure not considerably more complex than one pole switches.

SUMMARY

In an embodiment, the present invention provides a switch suited for multi-pole direct current service independent of polarity. The switch includes a plurality of switching chambers. Each of the switching chambers includes a double breaker having two separate fixed contacts, each with a first contact area; a movable electrically conductive contact piece with two secondary contact areas, each for creating an electrically conductive connection between the first and second contact areas in an ON state of the switch and for separating the first and second contact areas in an OFF state of the switch; and at least two quenching devices for quenching arcs that can occur between the first and second contact areas when the OFF state is brought about. The switch also includes at least two magnets configured to generate a magnetic field at least in a region of the first and second contact areas of the switching chambers so as to exert a magnetic force on the arcs so that at least one of the arcs is driven in a direction of one of the quenching devices independently of the current direction in the arc. The contact pieces of the switching chambers are placed such that the second contact areas are essentially in a line perpendicular to a direction of motion of the arcs. At least two of the switching chambers are disposed in a plane and two additional quenching devices extend toward the other of the first and second contact areas. At least one of the additional quenching devices is configured as a second quenching chamber and second arc deflector plates extend from the second quenching chamber toward the first and second contact areas.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
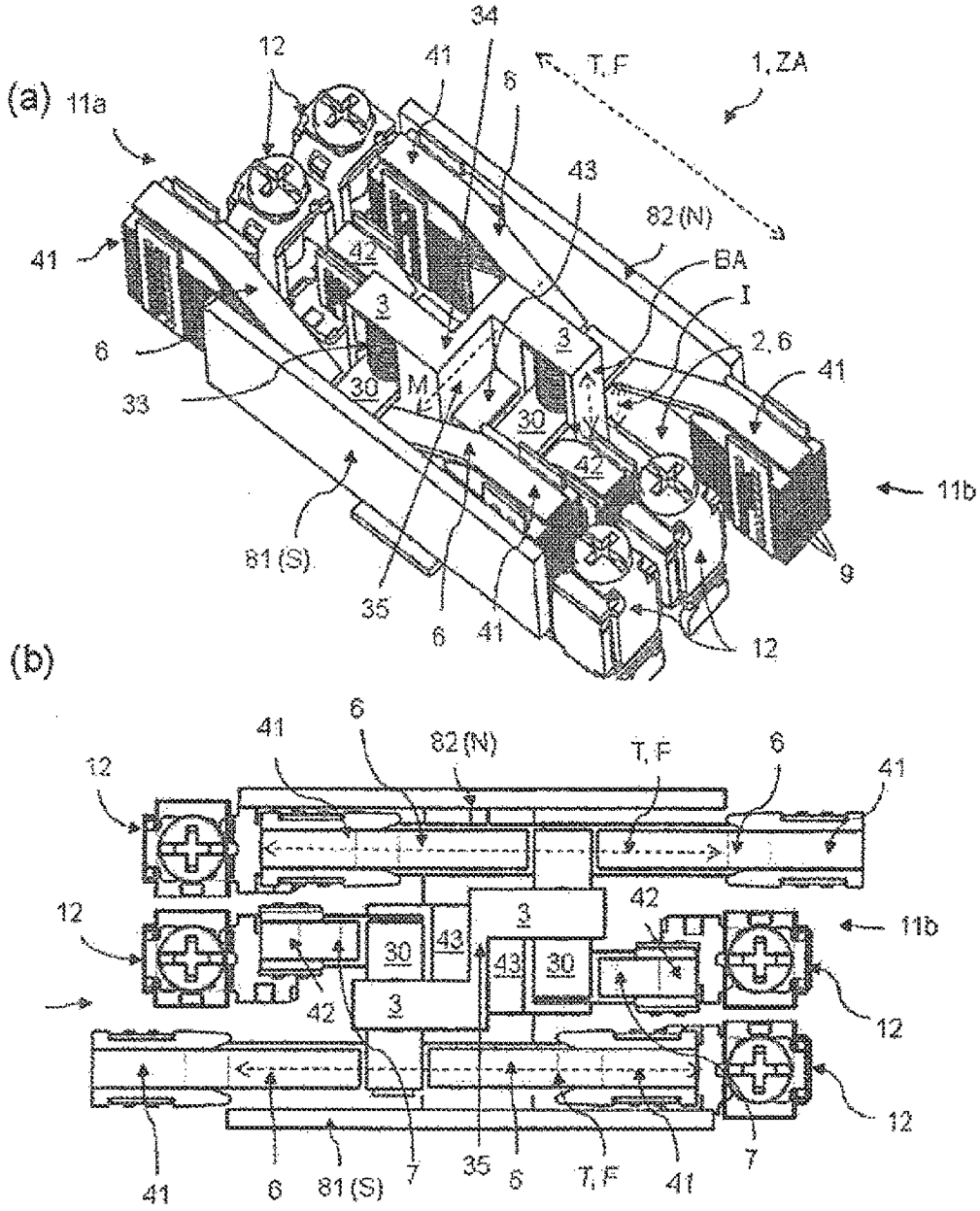
FIG. 1 shows an embodiment of a switch with two switching chambers aligned in one plane presented in (a) perspective view and (b) top view.

One aspect of the present invention is to provide a switch capable of multi-pole operation, which can quench the arcs created quickly and reliably, independent of the direction of current.

In an embodiment, the present invention provides a switch capable of polarity-independent multi-pole direct current operation with at least two switching chambers, where each switching chamber consists of a double circuit breaker with two separate stationary contacts each with a first contact region and a movable electrically conductive contact with a second contact region to create an electrically conductive connection between the first and the second contact region in the ON state of the switch and to disconnect the first and the second contact region in the OFF state of the switch and at least two quenching mechanisms for quenching the arc which can form between the first and the second contact regions when switching to the OFF state; and also minimum two magnets to generate the electrical field at least in the area of the first and the second contact region of the switching chambers to exert a magnetic force on the arcs to divert at least one of the arcs in the direction of one or the other quenching chamber independent of the direction of current, where the contact parts of the switching chambers are aligned to ensure that the second contact regions in line are essentially perpendicular to the direction of movement of the arcs. The switch has a quick, reliable quenching operation independent of the direction of current and therefore prevents faulty installation caused by incorrect polarity and it can be used for applications requiring a switch for both directions of current. The term "essentially" comprises in case of the present invention all implementations which deviate by less than 10% from the nominal value or the mean value.

The switch comprises all types of switches suitable for multi-pole operation with switching chambers comprising at least two stationary contacts which can be electrically closed using at least one movable contact part. These switches can be two pole or multi-pole switches for example. There can be two or more switching chambers, and the switching chambers are operated preferably aligned in parallel to each other. Alternative embodiments of the present invention can include switches in case of which the two or more switching chambers are connected in series and therefore they are operated technically as a one pole switch. These switches are, however, suited for multi-pole operation, because they only require changing the circuitry of the switching chambers for multi-pole operation. Examples of these switches are contactors, load disconnecting switches or power switches. Here the switch is suited for direct current operation, but could also be used in alternating current service. Polarity-independent direct current operation designates the operation of the switch in a direct current circuit, the arc in the switch being quickly quenched regardless of the direction of the current. In this case the arcs can be formed between the first and the second contact region of the two switching chambers, and the current flows from the first to the second contact region or the other way round. The essentially constant magnetic field with a fixed direction (determined by fitting the magnets in the switch) drives the arc in case of a fixed direction of current always in the direction defined by the Lorentz force and therefore in case of operating the switch with the opposite direction of current (second direction of current in the arc) there should be other measures implemented for the quick quenching of the arc, that is, at least two quenching chambers are installed for each switching chamber, and they are installed opposite to the first and the second contact region for the two possible directions of forces due to the two possible directions of current in the arc. One arc is quenched reliably with this setup, and this leads to quenching the other arc as well. The switching chamber comprises preferably four quenching mechanisms for quenching both arcs reliably in the respective quenching mechanisms. The advantage of the claimed arrangement is the simple, symmetrical and consequently cost-effective construction of the switch. The stronger the magnetic field at the location of the arc, the faster the arc is driven into the quenching chamber; and in this process the arc is quenched. The quenching mechanism can be any device suited for quenching an arc, for example heat sinks or quenching chambers.

In this context the double circuit breaker refers to the mechanical components, which perform a double interruption of an electric circuit. For this reason, double circuit breakers are fitted with two first and two second contact regions where the current is always ruptured (double) in the OFF state. In a double circuit breaker, the first and the second contact region refer to the surfaces of the stationary contacts and of the movable contacts, which are in direct contact after closing the switch (ON state). In the ON state, the current flows from one of the two first contacts through the first contact region into the connected second contact region, from the latter through the electrically conductive contact part to the other second contact region of the contact part and from there through the contacted other first contact region in the other stationary contact. The first contacts and the first and second contact regions and the contact part are therefore made of an electrically conductive material. For closing the contacts (ON state) the contact part with the second contact regions moves unto the first contact regions. The first and the second contact regions can be sub regions of the stationary contact or of the contact part or separate components, which are located on the stationary contacts or on the contact part. The above movement is performed along a movement axis of the contact part, perpendicular to the surface areas of the contact regions. The contact part is for example mounted in a bridge structure made preferably of plastic, held in a movable position with a spring, which exerts the necessary contact pressure in the ON state of the switch. The movement axis of the contact part is aligned essentially perpendicular to the direction of movement of the arc in the quenching mechanisms. The switch is opened by moving the contact part in the opposite direction. The contact part can be moved manually or electrically. The first and second contact areas can differ in shape and in material. Here the surfaces of the first and second contact areas can vary between extended surfaces and dot-like contacts. The material of the contact areas can be any suitable electrically conductive material, for example silver tin oxide.

The magnetic field exerts a driving force on the arcs. The greater the magnetic field strength at the location of the arc, the more strongly the driving Lorentz force acts on the arc. For quickly quenching the arc with current flows in both directions it is advantageous that a strong magnetic field can operate in the movement path of the arc for both current directions. A very strong permanent magnetic field can be supplied by a permanent magnet which for example is a rare-earth magnet. Rare-earth magnets consist for example of a NdFeB or SmCo alloy. These materials generate a very strong coercive field and therefore the magnets can be shaped as very thin plates for example resulting in a very compact structure of the switch. The time required for driving the arcs into the quenching chambers and along the cooling plates depends on the strength and homogeneity of the magnetic field. Therefore the permanent magnets are aligned preferably in such a way that they generate a magnetic field perpendicular to the current flow of the arc and perpendicular to the desired direction of movement of the arc. The specialist can select the appropriate form of the magnet part of this invention. The magnets are aligned preferably in pairs of 2 magnets, therefore two magnets or multiples thereof are preferably used in a switch. In an embodiment, at least two plate-shaped magnets are used, preferably permanent magnets, and their surfaces are aligned parallel to each other. The surfaces of the magnets are aligned preferably parallel to the direction of movement of the arcs. The magnets are preferably aligned to generate an essentially homogeneous magnetic field along the direction of movement of the arcs. In an embodiment of the invention a permanent magnet is used. The term "essentially" comprises in case of the present invention all implementations which deviate by less than 10% from the nominal value or the mean value. In a different embodiment which can be combined with the previous embodiment, the magnets extend at least to the quenching mechanisms or even over them to generate a homogeneous magnetic field for the entire path of travel and propagation of the arc. In an embodiment of a switch presented in this invention, the magnets are aligned laterally outside the structure of the switching chambers (in a single plane or on top of each other or in a different structure) to generate an essentially homogeneous magnetic field at least in the area of the first and second contact region of the double circuit breaker of several switching chambers.

In an embodiment of the invention, at least in one of the switching chambers the first arc deflector plates extend in two opposite directions from one of the first contact regions and from the corresponding second contact regions to two quenching mechanisms located at the two ends of the arc deflector plates presented as the first quenching chambers. The term "extend" comprises the possible implementations that the arc deflector plates (or the cooling plates) project to the respective contact regions (or quenching mechanisms), without being fixed permanently to them, or the arc deflector plates (or cooling plates) can have a fixed connection with the contact regions (or with the quenching mechanisms). The first arc deflector plates are preferably fixed to the first contact region though. Consequently obstacles to the movement of the arc, such as air gaps for example, are avoided, at least for the stationary contacts. The first quenching chamber comprises of all types of components, which are suitable for quenching an arc. In an embodiment, the quenching chamber comprises a variety of arc deion plates between the first arc deflector plates, which are both aligned in parallel to each other in the quenching chamber. In order to quench an arc quickly, the magnets exert a Lorentz force on the arc preferably for the period until the arc enters the quenching mechanism. If there is sufficient overall space inside the switch, it is therefore beneficial to align the permanent magnets as close as possible to the first quenching chambers or even laterally over and above the first quenching chambers. The deion plates in the first quenching chamber are V-shaped for example. In the first quenching chamber, the arc is split up into a multitude of partial arcs (deion chamber). The minimum voltage required for maintaining the arc is proportional to the number of deion plates installed in the first quenching chamber, and therefore the voltage required for maintaining the arc exceeds the available voltage, and the arc is quenched. The deion plates are fixed in an insulating material to which the arc deflector plates are also fixed. The arc deflector plates can be of any form which is appropriate for deflecting the arc in the first quenching chamber. The arc deflector plates can also be implemented as stamped bent parts. The thickness and width of the arc deflector plates can also vary. The spacing between the first (lower) and the second (upper) arc deflector plate can then increase with increasing separation from the first and second contacts. In an embodiment the magnets extend at least along the first arc deflector plate up to the first quenching chambers, preferably over the first quenching chambers.

In an embodiment at least two switching chambers are aligned in one plane; and all switching chambers are aligned preferably in one plane. This offers the advantage that the switch has a more simple symmetrical structure and low installation height and depth and therefore the manufacturing process becomes more cost-efficient. In an embodiment adjacent switching chambers have a common bridge setup for moving the contact parts with a common bridge, for driving the contact parts and for electrically insulating the switching chambers from each other. The bridge provides the electrical isolation of the switching chambers from each other. Therefore the bridge can be made of plastic at least in part for example. The shape of the bridge can vary between different embodiments of the switch according to this invention. The specialist can select the appropriate size and shape of the bridge within the framework of this invention. The bridge structure is designed to ensure that the contact parts of both double circuit breakers are moved simultaneously, thus both contact parts are moved either into the ON state or into the OFF state of the switch. The two contact parts are not moved independent of each other.

In an embodiment of this switch two additional quenching mechanisms extend to the other first and second contact regions (which are not yet connected with the first quenching chambers), where at least one of the two quenching mechanisms is implemented as a second quenching chamber and the second arc deflector plates extend from the second quenching chamber to the first and second contact regions. The second quenching chamber can have a similar or practically identical structure as the first quenching chamber and if applicable, it can comprise the parts which have already been presented in case of the first quenching chamber. Due to the tighter position of the second quenching chamber, the size of the second quenching chamber can be smaller at the movable contact part than at the first quenching chamber. In an embodiment the second quenching chamber is of smaller size than the first quenching chamber and it is installed at a closer distance to the contact part than the first quenching chamber.

In a further embodiment of the above switch, a cooling plate is installed as the other quenching mechanisms, and this plate extends from the contact part along the axis of movement of the contact part around the first contact region to the rear side of the stationary contact opposite to the contact part, preferably having the distance between the cooling plate and the rear side of the stationary contact widen along the direction of movement of the arc. Here the cooling plate extends to the second contact region of the movable contact part. Due to an arc forming between the first and the second contact regions when disconnecting the switch, it is purposeful to have the cooling plate reach to the area of the arc to divert and thus quench the arc quickly. The distance between the cooling plate and the rear side of the stationary contact preferably widens with the increasing distance to the axis of movement of the contact part. The arc path is thereby lengthened and consequently the voltage required to maintain the arc is increased. When the voltage of the arc exceeds the operating voltage of the switch, the arc is quenched. In a preferred setup of the magnets one of the arcs is driven between one of the first and second contact regions into the first quenching chamber and the other arc is driven between the first and the second contact regions into the second quenching chamber. When operating the switch with the opposite direction of current, the quenching operation is performed the same way, however, one of the arcs is driven in the other first quenching chamber and the other arc is driven to the cooling plate acting as the other quenching mechanism, instead of the second quenching chamber.

In an embodiment the contact parts of the double circuit breaker are offset of each other in one plane to ensure that the cooling plates of adjacent switching chambers are separated by a shared wall of the bridge essentially in parallel with the contact parts. This setup provides an extremely small structure of the switch.

In an alternative embodiment of the switch presented in this invention, there are at least two switching chambers aligned on top of each other. Based on the configuration of this structure and the space it provides, it is possible to use quenching chambers for all quenching mechanisms. This setup helps avoid driving an arc for quenching in the direction of the bridge structure, and therefore it eliminates an increased thermal stress on the bridge structure and thus it increases the service life of the switch. Furthermore, this embodiment is fitted only with first quenching chambers, and this can help reduce the installation height per pole. Using the symmetrical structure of switching chambers feasible in this manner, the arcs will have a more favourable driving behaviour.

In an embodiment of the switch with switching chambers aligned on top of each other, the first arc deflector plates extend in each of the two opposite directions in the first quenching chambers. The arc deflector plates available for all directions of movement help quenching the arcs quickly and securely for each direction of current in the arc and each polarity of the magnetic field. The first arc deflector plates are preferably fixed to the first contact region though. Consequently obstacles to the movement of the arc, such as air gaps for example, are avoided, at least for the stationary contacts.

In a further embodiment of the switch with switching chambers aligned on top of each other, the movement axes of the contact parts are located between the arc deflector plates, the axes of movement of the contact parts coincide preferably. This facilitates a very compact structure.

In an alternative embodiment of aligning the switching chambers of the switch presented in this invention, some switching chambers can be aligned in parallel and other switching chambers aligned on top of each other.

In an embodiment switching chambers aligned on top of each other have a common bridge setup for moving the contact parts with a common bridge, for driving the contact parts and for electrically insulating the switching chambers from each other. There are analogous embodiments concerning the bridge and the mechanical characteristics of the bridge structure as compared to the structure of the switching chambers in one plane.

FIG. 1 shows the design of a switch 1 according to the present invention with two switching chambers 11*a*, 11*b* set in one plane in (a) perspective view and (b) in top view from above. Each of the switching chambers 11*a*, 11*b* has a double interrupter with two separate fixed contacts 2 with one first contact area 21, 22 each and one fixed electrically conductive contact piece 30 with two second contact areas 31, 32 for respectively creating an electrically conducting connection between the first and second contact areas 21, 22, 31, 32 in the ON state of switch 1 and for separating the first and second contact areas in the OFF state of switch 1 along the axis of movement BA of the bridge placement. Spring 33 puts the necessary contact pressure on the contact piece 30 during the ON state. The switch with the switching chambers 11*a*, 11*b* in one plane possesses four erasing devices 41, 42, 43 for erasing arcs that can occur during the creation of the OFF state between the first and second contact areas 21, 22, 31, 32. The arcs aren't shown in detail here, see FIG. 2 instead. The four erasing devices per switching chamber are in FIG. 1 two first erasing chambers 41, one second erasing chamber 42 and one cooling plate 43 attached to the bridge placement. The two magnets 81, 82 placed within the switch for producing a magnetic field M stretch here from the first and second contact areas 21, 22, 31, 32 past the first erasing chambers 41 and are embodied as plate magnets 81, 82 with areas placed parallel to each other. Magnet 81 forms the magnetic north pole (N) for the switching chambers in this example and the magnet 82 the magnetic south pole (S) with a corresponding magnetic field direction M between the magnets 81, 82, depicted by the dashed arrow M. This creates on the entire movement path T of the arc an essentially homogeneous magnetic field all the way into the first erasing chambers 41 and thus a strong magnetic force F is provided for fast erasure of the arcs. The four erasing devices 41, 42, 43 ensure that each arc is driven independent of the current direction I in the arc into the direction of one of the erasing devices 41, 42, 43. Which of the erasing devices 41, 42, 43 erases the arcs concerned depends on the field direction of the magnetic field and the current direction I in the arc and the resulting direction of the Lorentz force F on the arc. For fast erasure of the arcs the displayed switching chambers 11*a*, 11*b* have first arc guide plates 6 that stretch in two opposite directions each from at least one of the first contact areas 21 and the corresponding second contact area 31 to two erasing chambers 41 each placed at the end of the arc guide plate 6. The second erasing chamber 42 is connected analogously to the first erasing chamber via two arc guide plates 7 with the first and second contact areas 22, 32. The expression "connected" also describes arc guide plates that stretch close to the contact areas. The second erasing chamber 42 has in this embodiment smaller dimensions than the first erasing chamber 41 and is placed at a smaller distance from contact piece 30 than the first erasing chamber 41.

In this embodiment the neighbouring switching chambers 11*a*, 11*b* have a common bridge placement 3 for moving the contact pieces 30 with a common bridge 34 for guiding the contact pieces 30 and for electrically isolating the switching chambers 11*a*, 11*b* from each other. The common bridge placement 3 reduces the number of required construction parts in the switch and thus allows for more affordable manufacturing. The common bridge placement 3 can for example be manufactured out of plastic so the electric isolation between the switching chambers 11*a*, 11*b* is guaranteed. For a compact design of switch 1 the contact pieces 30 of the switching chambers 11*a*, 11*b* are placed so that the second contact areas 31, 32 are essentially in a line vertical to the direction of movement T of the arcs 5. For a further reduction of the necessary construction volume the contact pieces 30 of the double interrupters are placed offset to each other in such a way on a plane that the cooling plate 43 of neighbouring switching chambers 11*a*, 11*b* are essentially separated from one another by a common wall 35 of the bridge 34 parallel to the contact pieces 30. The attachment clips 12 serve to attach the switching chambers 11*a*, 11*b* to an electric circuit.

Figure 2:
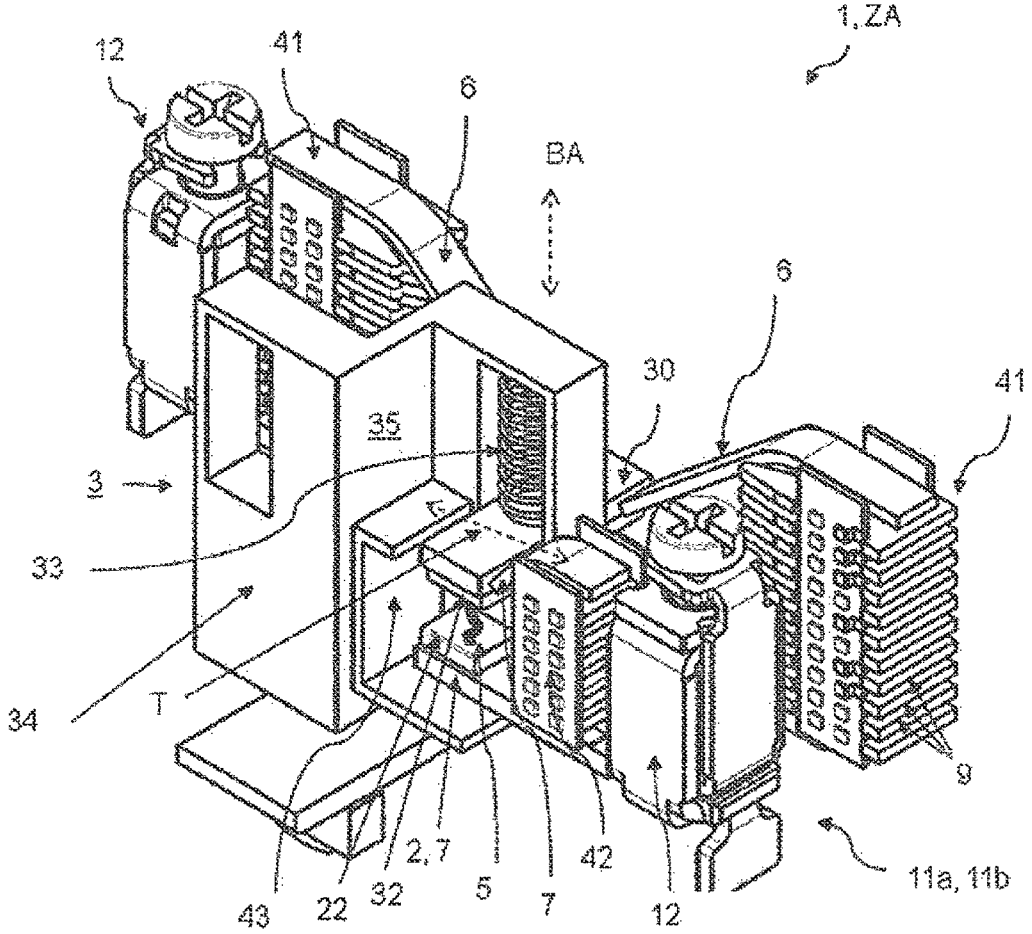
FIG. 2 shows a perspective view of a section of FIG. 1 with one switching chamber and the bridge structure.

FIG. 2 shows a perspective partial section of the switch from FIG. 1 with one of the switching chambers 11*a*, 11*b* and the common bridge placement 3. For a better overview the magnets and one of the switching chambers were left off FIG. 1. The components labelled "12" are the attachment clips 12 of the switching chambers 11*a*, 11*b* for attaching the switching chambers 11*a*, 11*b* to the electric circuit. This figure depicts an arc 5 between the first and second contact areas 22, 32 that is moving along the direction of movement T (dashed arrow) dependent on the direction of the magnetic field and the current direction in arc 5 either into the second erasing chamber 42 or along the cooling plate 43. The corresponding other arc between the other first and second contact areas 21, 31 is not displayed here. In order to make the erasing behaviour particularly beneficial, a second arc guide plate 7 stretches from the second erasing chamber 42 in the direction of the first and second contact areas 22, 32. The cooling plate 43 is mounted onto the common wall 35 of the bridge 34. A corresponding other cooling plate for the other not shown switching chamber is mounted onto the other side of the wall 35 not visible here. The cooling plate 7 stretches here for a reliable erasure of arc 5 from the second contact area 32 of the contact piece 30 around the fixed contact 2 to its back side.

Figure 3:
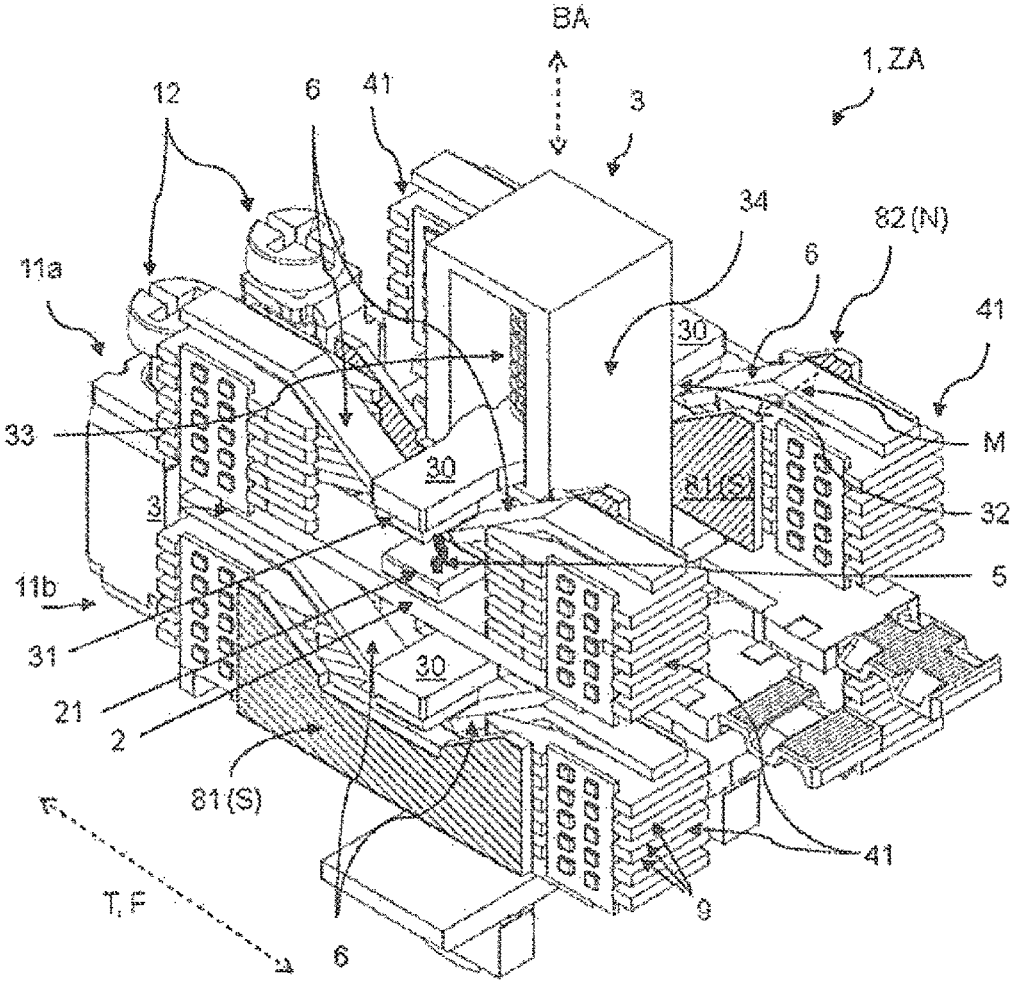
FIG. 3 shows another design of a switch with two switching chambers each placed above one another in perspective view

FIG. 3 displays a side view of switch 1 in the OFF state ZA according to the present invention with two switching chambers 11*a*, 11*b* each placed on top of each other. Here the switching chambers 11*a*, 11*b* possess contrary to FIG. 1 four first erasing chambers 41, for each of which two erasing chambers 41 are placed opposite the corresponding first and second contact areas 21, 22, 31, 32 of the corresponding double interrupter. Here the axes of movement (BA) of the respective contact pieces 30 lying on top of each other run between the arc guide plates 6, preferably the axes of movement BA of the respective contact pieces 30 cover each other. The advantage of this placement is that none of the arcs 5 run in the direction of the bridge placement 3. For reasons of overview the magnets for exerting the Lorentz force onto the arcs 5 are omitted here in part. In the upper switching chamber 11*a* an arc 5 is depicted that has a magnet placement 81, 82 as in the lower switching chamber 11*b*. In this embodiment a pair of magnets 81, 82 is placed per switching chamber. In an alternative embodiment, analogous to FIG. 1, only 1 pair of magnets 81, 82 can be placed per level.

Figure 4:
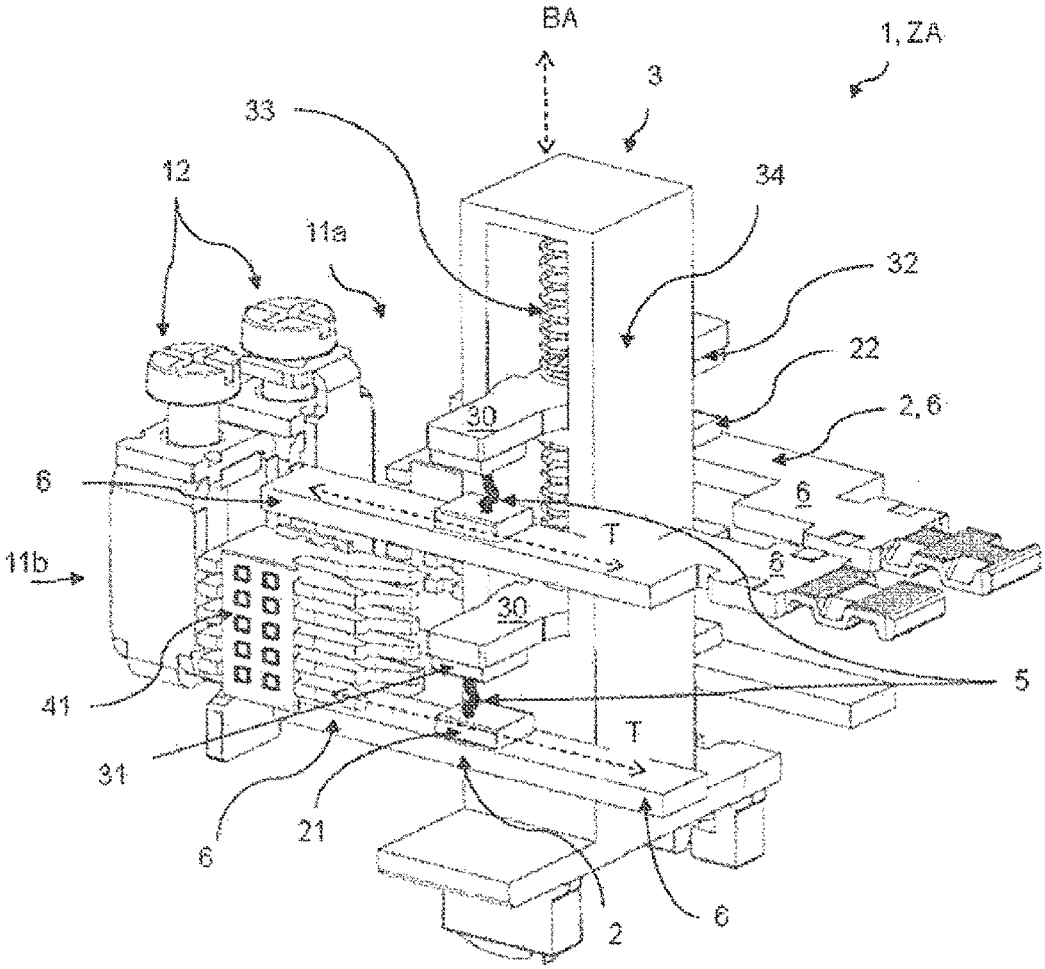
FIG. 4 shows a perspective view of the bridge placement of the switch from FIG. 3.

FIG. 4 displays a perspective view of the bridge placement 3 of switch 1 from FIG. 3 in the OFF state ZA, where for reasons of clarity several of the components displayed in FIG. 3 are left off. The switching chambers 11*a*, 11*b* stacked on top of each other have a common bridge placement 3 as shown here in this embodiment for the common simultaneous movement of contact pieces 30 of both switching chambers with a common bridge 34 for guiding the contact pieces 30 and for electrically isolating the switching chambers 11*a*, 11*b* against each other. The bridge placement 3 including the contact pieces 30 of the two double interrupters and the bridge 34 of the switching chambers 11*a*, 11*b* placed on top of each other forms a mechanical unit. This common bridge placement allows a compact design of the switch. The common bridge placement 3 can for example be manufactured from plastic so the electric isolation between the switching chambers 11*a*, 11*b* is guaranteed. The arcs 5 burning between the first and second contact areas of the switching chambers 11*a*, 11*b* placed on top of each other are always driven along the direction of movement T dependent on the direction of the magnetic field and the current direction in arc 5 into one of the first erasing chambers 41 and thus away from the bridge placement 3 (here only 1 of the erasing chambers 41 is shown for the sake of clarity). The attachment clips 12 serve to attach the switching chambers 11*a*, 11*b* to the electric circuit.

The detailed description of the invention in this section and in the figures is to be understood as an example of possible embodiments within the scope of the invention, and not in a limiting sense. In particular, indicated dimensions are to be adapted to the respective operating requirements of the switch (current, voltage) by a person skilled in the art. Consequently, all dimensions given are to be understood only as examples for specific embodiments.

Alternative embodiments, which a person skilled in the art may contemplate within the scope of the present invention, are also encompassed in the scope of protection of the present invention. In the claims, expressions such as "a", "an" or "one" also include the plural. Reference symbols used in the claims are not to be construed as limiting.

REFERENCE SYMBOL LIST

1 Switch according to the present invention
11*a*, 11*b* Switching chambers
12 Attachment clips of the switching chambers
2 Fixed contact
21, 22 First contact areas
23 Back side of the fixed contacts
3 Bridge placement
30 movable contact piece
31, 32 Second contact areas
33 Spring of the bridge placement
34 Bridge
35 Wall of the bridge
41 first erasing chamber
42 second erasing chamber
43 Cooling plate
5 Arcs
6 first arc guide plate
7 second arc guide plate
81, 82 Magnets, preferably permanent magnets
9 Erasing plate
BA Axis of movement of the movable contact piece
I Current direction within the arc
M Magnetic field
F Lorentz force on the arc
T Direction of movement of the arc
ZA Open switch (OFF state)

The invention claimed is:

1. A switch suited for multi-pole direct current service, the switch comprising:

a plurality of switching chambers, each of the switching chambers including a double breaker having two separate fixed contacts, each with a first contact area, a movable electrically conductive contact piece with two secondary contact areas, each for creating an electrically conductive connection between the first and second contact areas in an ON state of the switch and for separating the first and second contact areas in an OFF state of the switch, and at least two quenching devices for quenching arcs that can occur between the first and second contact areas when the OFF state is brought about;

at least two magnets configured to generate a magnetic field at least in a region of the first and second contact areas of the switching chambers so as to exert a magnetic force on the arcs so that at least one of the arcs is driven in a direction of one of the quenching devices independently of the current direction in the arc, wherein the contact pieces of the switching chambers are placed such that the second contact areas are essentially in a line perpendicular to a direction of motion of the arcs, wherein at least two of the switching chambers are disposed in a plane and two additional quenching devices extend toward the other of the first and second contact areas, at least one of the additional quenching devices being configured as a second quenching chamber, and second arc deflector plates extending from the second quenching chamber toward the first and second contact areas.

2. The switch according to claim 1, further comprising first arc deflector plates in at least one of the switching chambers, each first are deflector plate extending in two opposite directions from at least one of the first contact areas and the corresponding second contact area to two quenching devices configured as first quenching chambers each positioned at the end of the arc deflector plates.

3. The switch according to claim 2, wherein the at least two magnets extend at least along the first arc deflector plates to the first quenching chambers.

4. The switch according to claim 1, wherein the magnets include at least two plate-shaped magnets having surfaces that are placed parallel to one another.

5. The switch according to claim 1, wherein the magnets are arranged laterally outside the switching chambers in such a way that they generate an essentially homogeneous magnetic field at least in the region of the first and second contact areas of the double breakers of several switching chambers.

6. The switch according to claim 1, wherein adjoining switching chambers have a common bridging device for moving the contact pieces with a common bridge for guiding the contact pieces and for electrically insulating the switching chambers from one another.

7. The switch according to claim 1, wherein either of the two additional quenching devices is configured as a cooling plate which extends from the contact piece along the movement axis of the contact piece around the first contact area to a back side of the fixed contact that is facing away from the contact piece.

8. The switch according to claim 7, wherein a spacing between the cooling plate and the back side of the fixed contact increases in the direction of motion of the arc.

9. The switch according to claim 1, wherein the second quenching chamber has smaller dimensions than the first quenching chamber and is positioned at a smaller spacing from the contact piece than the first quenching chamber.

10. The switch according to claim 7, wherein the contact pieces of the double breaker are offset between one another in a plane such that the cooling plates of adjoining switching chambers are separated by a common wall of the bridge substantially parallel to the contact pieces.

11. The switch according to claim 1, wherein at least two of the switching chambers are disposed one above the other.

12. The switch according to claim 11, wherein the first arc deflector plates extend in both of the two opposite directions into the first quenching chambers.

13. The switch according to claim 11, wherein the axes of motion of the respective contact pieces run between the arc deflector plates.

14. The switch according to claim 13, wherein the axes of motion of the respective contact pieces are congruent.

15. The switch according to claim 11, wherein the switching chambers positioned above one another have a common bridge device configured to move the contact pieces with a common bridge for guiding the contact pieces so as to electrically insulate the switching chambers from one another.

* * * * *